US011199187B2

(12) United States Patent
Oda et al.

(10) Patent No.: US 11,199,187 B2
(45) Date of Patent: Dec. 14, 2021

(54) PLUNGER PUMP

(71) Applicants: NITTOKU CO., LTD., Saitama (JP); NAKA LIQUID CONTROL CO., LTD., Moriguchi (JP)

(72) Inventors: Norio Oda, Omura (JP); Yasuhiro Tanaka, Omura (JP); Takahiro Sato, Fukushima (JP); Yuji Kanbayashi, Moriguchi (JP)

(73) Assignees: NITTOKU CO., LTD., Saitama (JP); NAKA LIQUID CONTROL CO., LTD., Moriguchi (JP)

( * ) Notice: Subject to any disclaimer, the term of this patent is extended or adjusted under 35 U.S.C. 154(b) by 0 days.

(21) Appl. No.: 16/756,760

(22) PCT Filed: Nov. 7, 2018

(86) PCT No.: PCT/JP2018/041373
§ 371 (c)(1),
(2) Date: Apr. 16, 2020

(87) PCT Pub. No.: WO2019/116790
PCT Pub. Date: Jun. 20, 2019

(65) Prior Publication Data

US 2020/0332794 A1 Oct. 22, 2020

(30) Foreign Application Priority Data

Dec. 13, 2017 (JP) ..... JP2017-238252

(51) Int. Cl.
*F04B 53/16* (2006.01)
*F04B 53/10* (2006.01)
(Continued)

(52) U.S. Cl.
CPC ..... *F04B 53/16* (2013.01); *B05B 11/303* (2013.01); *B05B 11/3016* (2013.01);
(Continued)

(58) Field of Classification Search
CPC ..... F04B 53/16; F04B 53/10; F04B 53/14; F04B 13/00; F04B 53/02; F04B 53/164;
(Continued)

(56) References Cited

U.S. PATENT DOCUMENTS 3,064,581 A * 11/1962 Tridgell ..... F04B 5/02 417/285
2005/0047941 A1* 3/2005 Humburg ..... F04B 13/00 417/416

FOREIGN PATENT DOCUMENTS

JP H06-280741 A 10/1994
JP H06280741 * 10/1994 ..... F04B 11/00
(Continued)

OTHER PUBLICATIONS

JPH06280741 translation (Year: 2021).*

*Primary Examiner* — Devon C Kramer
*Assistant Examiner* — David N Brandt
(74) *Attorney, Agent, or Firm* — Rabin & Berdo, P.C.

(57) ABSTRACT

A plunger pump, comprising: a liquid tank; a pump body including a liquid storage part, a suction passage configured to allow communication between the liquid storage part and the liquid tank and a discharge passage configured to discharge a liquid in the liquid storage part to outside; and a plunger reciprocally movably supported in the pump body so that a tip reaches the liquid storage part. The suction passage includes a first suction passage, the tip of the plunger being reciprocally slidably inserted into the first suction passage, and a second suction passage provided in parallel to the first suction passage, and a check valve configured to allow only a flow of the liquid from the liquid tank to the liquid storage space is disposed in the second suction passage.

4 Claims, 6 Drawing Sheets

(51) Int. Cl.

| | |
|---|---|
| ***F04B 53/14*** | (2006.01) |
| ***B05B 11/00*** | (2006.01) |
| ***F04B 23/02*** | (2006.01) |
| ***F04B 13/00*** | (2006.01) |
| ***F04B 53/02*** | (2006.01) |

(52) U.S. Cl.
CPC ..... *B05B 11/3032* (2013.01); *F04B 53/10* (2013.01); *F04B 53/14* (2013.01); *F04B 13/00* (2013.01); *F04B 23/02* (2013.01); *F04B 53/02* (2013.01)

(58) Field of Classification Search
CPC ..... F04B 23/02; F04B 7/04; B05B 11/3016; B05B 11/303; B05B 11/3032; B05B 11/3001; B05B 11/3038; B05B 9/0413; A47K 5/1207; A47K 5/1211; B65D 83/0005; B65D 81/3255
See application file for complete search history.

(56) References Cited

FOREIGN PATENT DOCUMENTS

| | | | |
|---|---|---|---|
| JP | H08-182951 | A | 7/1996 |
| JP | 2003-028052 | A | 1/2003 |
| JP | 2005-090296 | A | 4/2005 |

* cited by examiner

PLUNGER PUMP

TECHNICAL FIELD

The present invention relates to a plunger pump.

BACKGROUND ART

For example, a conventional plunger pump 1 is disclosed which includes a cylinder 2 with a discharge passage 2*a* and a suction port 2*b*, a plunger 3 inserted in an insertion port 2*c* formed in the cylinder 2 and configured to be reciprocally movable, and a tank 4 for supplying a liquid to the cylinder 2 through the suction port 2*b* as shown in FIGS. 5 and 6.

A first check valve 5 configured to be opened when a pressure in the cylinder 2 becomes positive is provided in the discharge passage 2*a*, and a sealing member 7 configured to slide in contact with the outer peripheral surface of the plunger 3 is provided on an inner wall surface of the insertion port 2*c*. The sealing member 7 is configured to keep the inside of the cylinder 2 in a sealed state and prevent the leakage of the liquid. In such a plunger pump 1, a discharge amount of the liquid is determined by a volume of the plunger 3 having entered the cylinder 2.

On the other hand, since it has been required to reduce an application amount of the liquid in recent years, a diameter of the plunger 3 and an entrance amount need to be reduced. However, the problem is that it is difficult to maintain the sealed state with the sealing member 7 if the diameter of the plunger 3 is reduced, and the problem is that errors occur and the discharge amount varies if the entrance amount is reduced.

To solve these problems, JP2003-28052A discloses a plunger pump 1 in which an engagement port 2*d* reciprocally slidable with a tip part of a plunger 3 engaged therewith is formed in a cylinder 2 and an opening cross-sectional area of the engagement port 2*d* is made different from that of an insertion port 2*c* as shown in FIG. 5 or the tip part of the plunger 3 is directly insertable into and removable from an suction port 2*b* and an opening cross-sectional area of the suction port 2*b* is made smaller than that of the insertion port 2*c* as shown in FIG. 6. Here, in FIG. 5 in which the engagement port 2*d* is formed in the cylinder 2, a second check valve 6 configured to be opened when a pressure in the cylinder 2 becomes negative is disposed in the suction port 2*b* of the cylinder 2.

In such a plunger pump 1, if the opening cross-sectional area of the engagement port 2*d* or the suction port 2*b* is made smaller than that of the insertion port 2*c*, an amount of the liquid obtained by multiplying the entrance amount of the plunger 3 into the cylinder 2 from the insertion port 2*c* by a difference between the opening cross-sectional area of the engagement port 2*d* or the suction port 2*b* and that of the insertion port 2*c* can be discharged from the discharge passage 2*a*, and the liquid can be discharged with high accuracy even if the discharge amount is very small by making the difference between the opening cross-sectional area of the engagement port 2*d* or the suction port 2*b* and that of the insertion port 2*c* smaller.

By moving the plunger 3 in a removing direction from the insertion port 2*c* after the liquid is discharged, the pressure in the cylinder 2 becomes negative, the second check valve 6 is opened to supply the liquid in the tank 4 into the cylinder 2 from the suction port 2*b* in FIG. 5 in which the engagement port 2*d* is formed in the cylinder, and the liquid in the tank 4 is supplied into the cylinder 2 from the suction port 2*b*, from which the tip part of the plunger 3 was removed, in FIG. 6 in which the tip part of the plunger 3 is directly inserted into the suction port 2*b*.

SUMMARY OF INVENTION

However, it has been also required to discharge a very small amount of a highly viscous liquid in recent years. If such a highly viscous liquid is stored in the tank 4 of the conventional plunger pump 1, quick suction of the liquid from the suction port 2*b* cannot be expected. Thus, if the cylinder 2 is so formed for such a highly viscous liquid that the engagement port 2*d*, with which the tip part of the plunger 3 is engaged, communicates with outside as shown in FIG. 5, outside air may intrude into the cylinder 2 from the insertion port 2*c* when airtightness between the insertion port 2*c* and the plunger 3 is impaired in the case that the pressure in the cylinder 2 becomes negative by removing the plunger 3 from the insertion port 2*c*.

Further, if the tip part of the plunger 3 is directly inserted into the suction port 2*b* as shown in FIG. 6, a direct inflow of air from the suction port 2*b* is avoided, but the liquid is not supplied into the cylinder 2 until the tip part of the plunger 3 is removed from the suction port 2*b*. Thus, there is a phenomenon in which the pressure in the cylinder 2 becomes a large negative pressure until the tip part of the plunger 3 is removed from the suction port 2*b* and part of the liquid remaining in the cylinder 2 is evaporated due to a considerable pressure drop (negative pressure). Gas produced by evaporation causes a trouble by remaining in the cylinder 2 even after the tip part of the plunger 3 is removed from the suction port 2*b* and the liquid starts being supplied into the cylinder 2.

If gas is sucked into the cylinder 2 or produced by evaporation, a problem of being difficult to discharge an amount of the liquid in proportion to the entrance amount of the plunger 3 into the cylinder 2 from the discharge passage 2*a* remains due to the expansion or contraction of the gas.

The present invention aims to provide a plunger pump capable of discharging a liquid with high accuracy by preventing the suction and production of gas.

According to one aspect of the present invention, a plunger pump includes a liquid tank, a pump body including a liquid storage part, a suction passage configured to allow communication between the liquid storage part and the liquid tank, and a discharge passage configured to discharge a liquid in the liquid storage part to outside, and a plunger reciprocally movably supported in the pump body so that a tip reaches the liquid storage part, wherein the liquid is sucked into the liquid storage part from the liquid tank through the suction passage by a volume expansion of a liquid storage space formed between the liquid storage part and the plunger while the liquid is discharged from the discharge passage by a volume reduction of the liquid storage space as the plunger reciprocally moves, the suction passage includes a first suction passage, the tip of the plunger being reciprocally slidably inserted into the first suction passage, and a second suction passage provided in parallel to the first suction passage, and a check valve configured to allow only a flow of the liquid from the liquid tank to the liquid storage space is disposed in the second suction passage.

DESCRIPTION OF EMBODIMENT

Hereinafter, an embodiment is described with reference to the drawings.

A plunger pump 10 according to the present embodiment is a plunger pump for discharging (applying) a liquid and, particularly, a plunger pump suitable to discharge a liquid having a medium to high viscosity.

As shown in FIGS. 1 to 4, the plunger pump 10 according to the present embodiment is a plunger pump for discharging a liquid having a medium to high viscosity, e.g. an adhesive having a relatively high viscosity. The plunger pump 10 includes a pump body 11 formed with a liquid storage part 18 (see FIGS. 2 to 4) and a plunger 15 reciprocally movably supported in the pump body 11 such that a tip reaches the liquid storage part 18.

Figure 1:
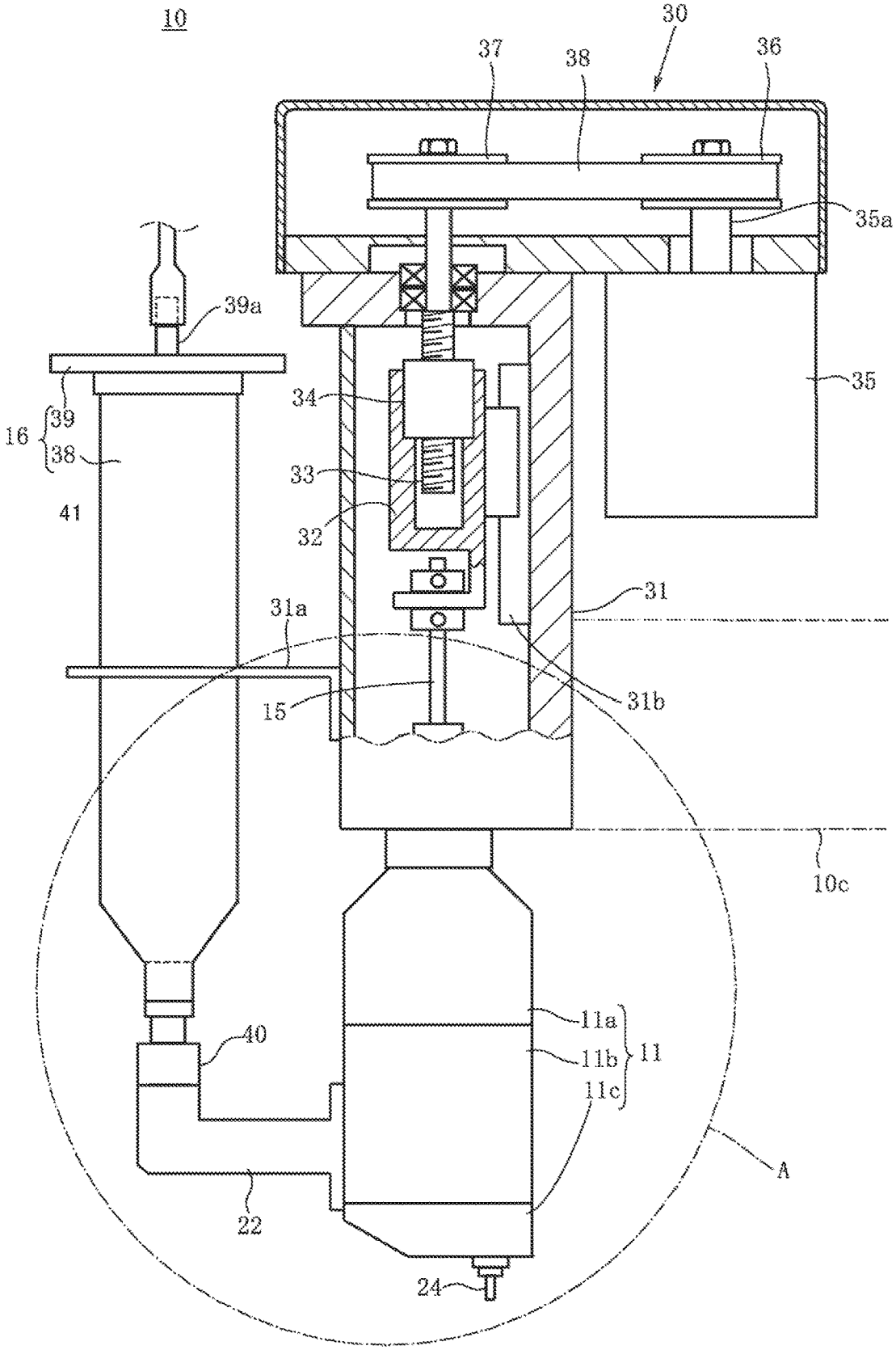
FIG. 1 is a front view partly in section of a plunger pump according to an embodiment.

As shown in FIG. 1, the pump body 11 is composed of three dividable upper, middle and lower divided pieces 11*a*, 11*b* and 11*c*, which are coupled and integrated by unillustrated bolt fastening means.

Figure 2:
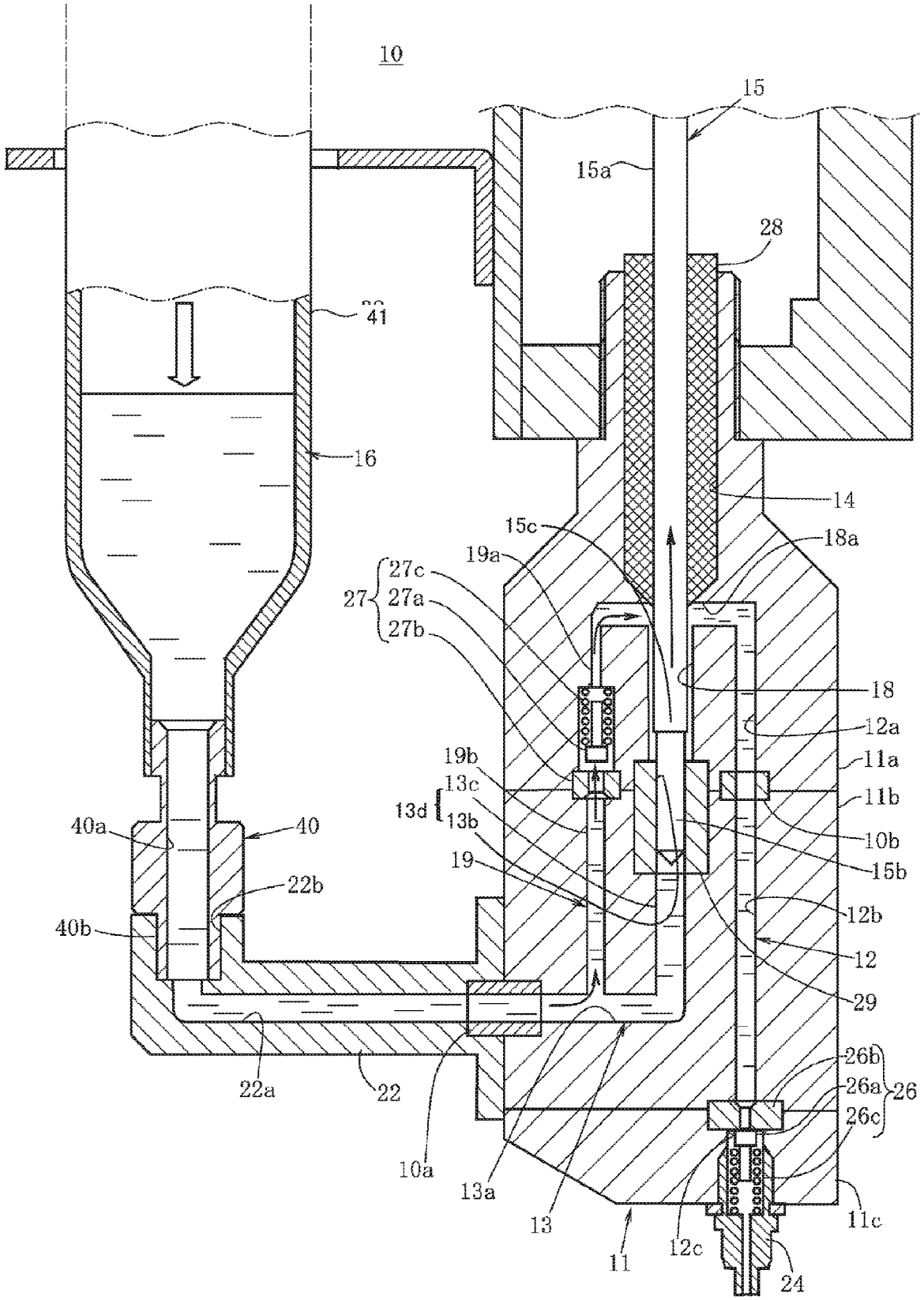
FIG. 2 is an enlarged sectional view of a part A of FIG. 1 showing a suction state of a liquid by the plunger pump.
Figure 3:
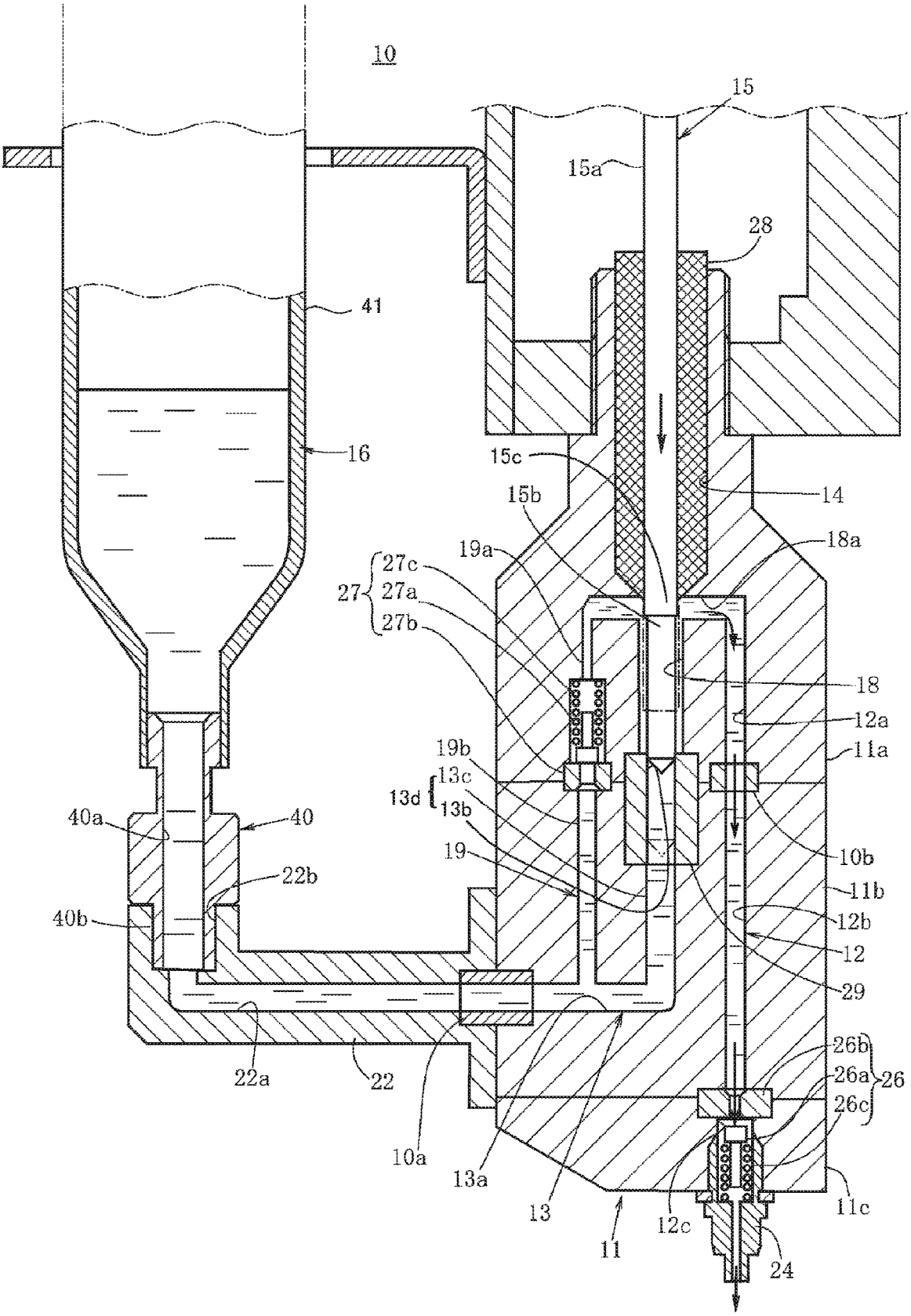
FIG. 3 is an enlarged sectional view of the part A of FIG. 1 showing a discharge state of the liquid by the plunger pump.
Figure 4:
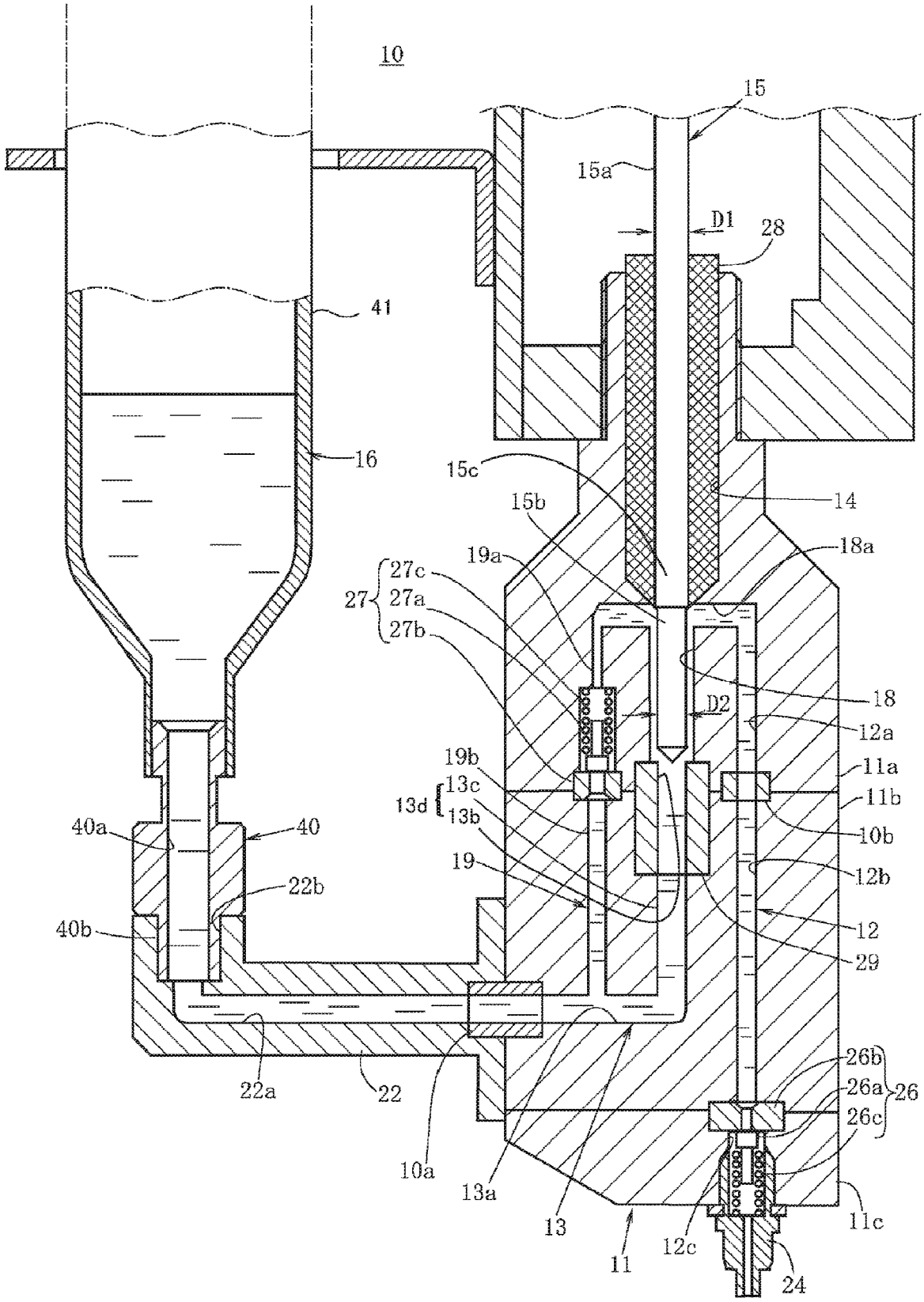
FIG. 4 is an enlarged sectional view of the part A of FIG. 1 showing a state where a tip of a plunger is removed from a first suction passage.
Figure 5:
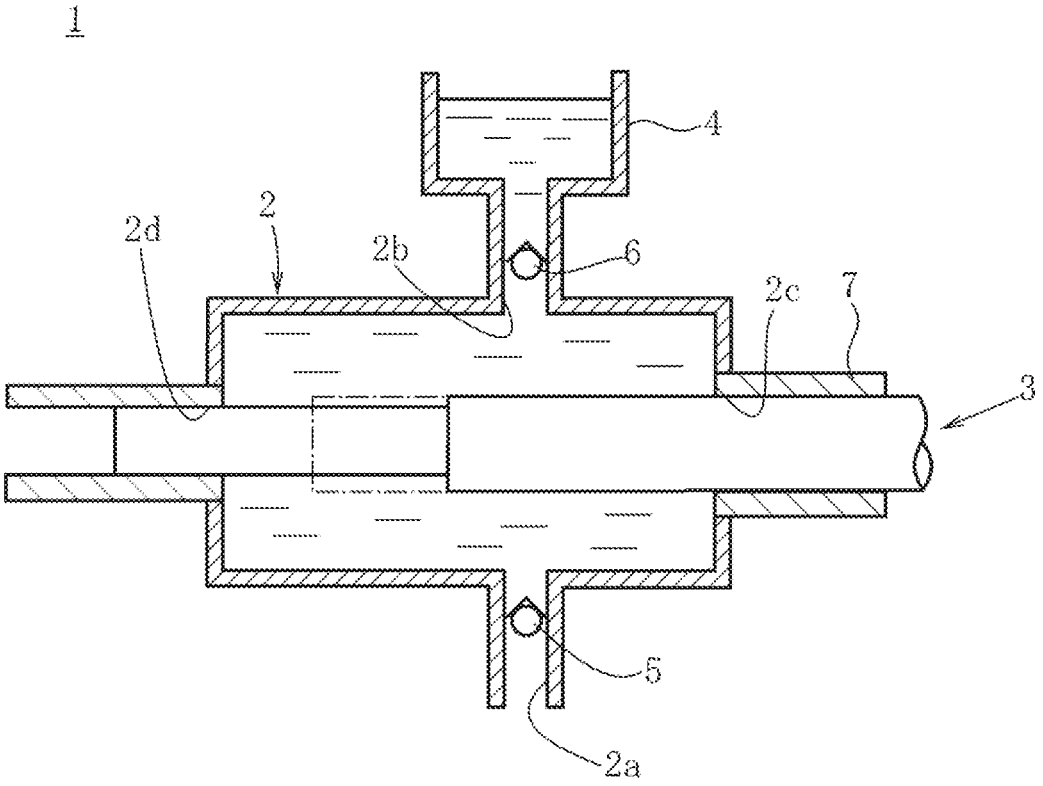
FIG. 5 is a sectional view showing the structure of a conventional plunger pump.
Figure 6:
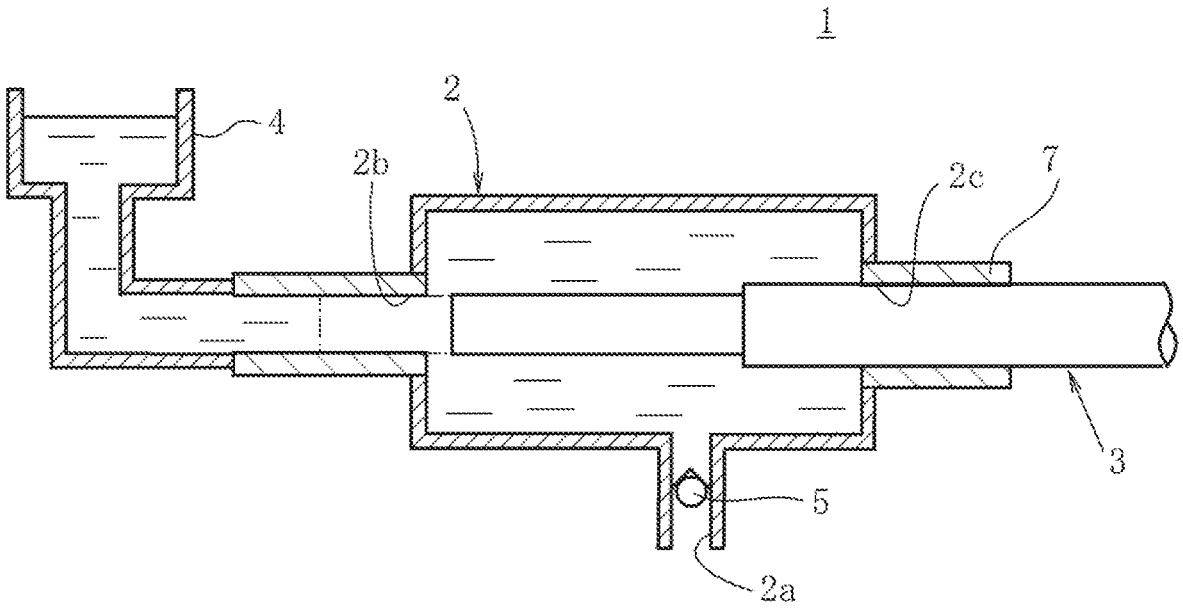
FIG. 6 is a sectional view showing the structure of another conventional plunger pump.

As shown in FIGS. 2 to 4, the upper divided piece 11*a* is formed with an insertion port 14 extending in a vertical direction from an upper end, a hole continuous with a lower end of the insertion port 14 and constituting the liquid storage part 18, and an upper first suction passage 13*b* continuous with a lower end of the liquid storage part 18. Specifically, the insertion port 14 is formed to communicate with one end (upper end) of the liquid storage part 18, and the upper first suction passage 13*b* is formed to communicate with the other end (lower end) of the liquid storage part 18. It should be noted that the insertion port 14, the liquid storage part 18 and the upper first suction passage 13*b* are coaxially formed.

The plunger 15 includes a first rod-like part (first rod part) 15*a* reciprocally slidably supported in the pump body 11 and having a first cross-sectional area, and a second rod-like part (second rod part) 15*b* formed coaxially with the first rod-like part 15*a* on a tip 15*c* of the first rod-like part 15*a* and having a second cross-sectional area different from the first cross-sectional area. Specifically, the first rod-like part 15*a* is inserted into the insertion port 14 and has the first cross-sectional area uniform in an axial direction, and the second rod-like part 15*b* has the second cross-sectional area uniform in the axial direction and different from the first cross-sectional area.

In the present embodiment, the first and second rod-like parts 15*a*, 15*b* are coaxially formed cylindrical parts as shown in FIG. 4. The second rod-like part 15*b* is so formed that a diameter D2 thereof is smaller than a diameter D1 of the first rod-like part 15*a*. For example, the diameter D1 of the first rod-like part 15*a* is illustrated to be 2.0 mm and the diameter D2 of the second rod-like part 15*b* is illustrated to be 1.9 mm. Specifically, the second cross-sectional area of the second rod-like part 15*b* is smaller than the first cross-sectional area of the first rod-like part 15*a*.

The plunger 15 is so inserted into the insertion port 14 that the second rod-like part 15*b* serving as a tip thereof reaches the liquid storage part 18. The insertion port 14 includes a cylindrical packing 28 held in close contact with the outer peripheral surface of the first rod-like part 15*a*. In this way, the first rod-like part 15*a* of the plunger 15 can reciprocally slide in the packing 28 along the vertically extending insertion port 14.

The packing 28 is a relatively long cylindrical combined (synthetic) packing used to reliably prohibit an inflow of outside air into the liquid storage part 18 and an outflow of the liquid from the liquid storage part through the insertion port 14. A diameter of the liquid storage part 18 communicating with the insertion port 14 is larger than an inner diameter of the packing 28 (i.e. diameter of the insertion port 14). In this way, the liquid can be stored in a liquid storage space formed between the outer peripheral surface of the plunger 15 and the inner peripheral surface of the liquid storage part 18 with the plunger 15 inserted in the liquid storage part 18.

Further, the plunger pump 10 includes a liquid tank 16 for storing the liquid. The pump body 11 is formed with a suction passage 13 allowing communication between the liquid tank 16 and the liquid storage part 18 and a discharge passage 12 for discharging the liquid in the liquid storage part 18 to outside.

The upper divided piece 11*a* is formed with an upper transverse hole 18*a* serving as one end of the liquid storage part 18. An upper discharge passage 12*a* having an upper end communicating with the upper transverse hole 18*a* and an upper second suction passage 19*a* having an upper end communicating with the upper transverse hole 18*a* are formed in parallel to the liquid storage part 18 to sandwich the liquid storage part 18. Specifically, the upper second suction passage 19*a* constituting a second suction passage 19 and the upper discharge passage 12*a* constituting the discharge passage 12 communicate with the one end of the liquid storage part 18.

A tank mounting piece 22 continuous with a lower end of the liquid tank 16 is mounted on the middle divided piece 11*b* to extend in a transverse direction, and formed with a flow hole 22*a* in which the liquid flows. The middle divided piece 11*b* is formed with a lower transverse passage 13*a* having one end (left end) communicating with the flow hole 22*a*, a lower second suction passage 19*b* having upper and lower ends respectively communicating with the upper second suction passage 19*a* and a center of the lower transverse passage 13*a*, and a lower first suction passage 13*c* having upper and lower ends respectively communicating with the upper first suction passage 13*b* and the other end (right end) of the lower transverse passage 13*a*.

The suction passage 13 allowing communication between the liquid storage part 18 and the liquid tank 16 includes the lower transverse passage 13*a*, a first suction passage 13*d* composed of the upper and lower first suction passages 13*b*, 13*c* and extending in the vertical direction, and the second suction passage 19 composed of the upper and lower second suction passages 19*a*, 19*b* and extending in the vertical direction. The first suction passage 13*d* communicating with the other end (lower end) of the liquid storage part 18 has a uniform diameter D2 and is configured to sandwich the liquid storage part 18 between the first suction passage 13*d* and the insertion port 14 in the vertical direction. The plunger 15 is configured such that the first rod-like part 15*a* thereof is not insertable into the first suction passage 13*d* and the second rod-like part 15*b* thereof is insertable into the first suction passage 13*d*.

Specifically, the suction passage 13 allowing communication between the liquid storage part 18 and the liquid tank 16 includes the first suction passage 13*d* having the second rod-like part 15*b* of the plunger 15 reciprocally movably inserted therein, and the second suction passage 19 provided in parallel to the first suction passage 13*d*.

A hollow cylindrical sealing member 29 to be held in close contact with the outer peripheral surface of the second rod-like part 15*b* is provided in a part (i.e. the upper first suction passage 13*b* and an upper part of the lower first suction passage 13*c*) of the first suction passage 13*d*. Specifically, the sealing member 29 is provided over the upper and middle divided pieces 11*a*, 11*b*. The second rod-like part 15*b* can reciprocally slide in the sealing member 29 along the first suction passage 13*d* extending in the vertical direction while being inserted in the first suction passage 13*d*. The sealing member 29 is configured to keep the liquid storage part 18 in the pump body 11 in a sealed state and prevent the leakage of the liquid from the liquid storage part 18 toward the first suction passage 13*d*.

Further, in the middle divided piece 11*b*, a middle discharge passage 12*b* sandwiching the first suction passage 13*d* between the middle discharge passage 12*b* and the lower second suction passage 19*b* is formed in parallel to the first suction passage 13*d* to be continuous with a lower end of the upper discharge passage 12*a*.

A lower discharge passage 12*c* continuous with a lower end of the middle discharge passage 12*b* is formed to penetrate through the lower divided piece 11*c*. In the present embodiment, the discharge passage 12 is composed of the upper, middle and lower discharge passages 12*a*, 12*b* and 12*c*. A nozzle 24 for discharging the liquid flowing in the lower discharge passage 12*c* to outside is mounted on a lower end of the lower discharge passage 12*c* via a discharge-side check valve 26. The discharge-side check valve 26 is a check valve for allowing only a flow of the liquid from the liquid storage space to outside.

The discharge-side check valve 26 includes a valve body 26*a*, a valve seat 26*b* and a spring 26*c* for biasing the valve body 26*a* into contact with the valve seat 26*b*, and the valve seat 26*b* is interposed between the middle and lower divided pieces 11*b*, 11*c*. The valve body 26*a* and the spring 26*c* are inserted into the lower discharge passage 12*c*. As shown in FIG. 3, the discharge-side check valve 26 is configured to be opened by the separation of the valve body 26*a* from the valve seat 26*b* against a biasing force of the spring 26*c* if a pressure in the liquid storage part 18 (liquid storage space) of the pump body 11 becomes positive (i.e. the pressure in the liquid storage part 18 becomes higher than an atmospheric pressure). In this way, the liquid is discharged from the liquid storage part 18 (liquid storage space) to outside through the discharge passage 12 and the nozzle 24.

As shown in FIG. 2, the discharge-side check valve 26 is configured to close the lower discharge passage 12*c* by the contact of the valve body 26*a* with the valve seat 26*b* due to the biasing force of the spring 26*c* and prevent a flow of outside air into the liquid storage part 18 through the discharge passage 12 if the pressure in the liquid storage part 18 of the pump body 11 becomes negative (i.e. the pressure in the liquid storage part 18 becomes lower than the atmospheric pressure).

On the other hand, a suction-side check valve 27 serving as a check valve is provided in a lower end of the upper second suction passage 19*a* of the upper divided piece 11*a*. The suction-side check valve 27 is a check valve for allowing only a flow from the liquid tank 16 to the liquid storage space. Further, similarly to the suction-side check valve 26, the suction-side check valve 27 includes a valve body 27*a*, a valve seat 27*b* and a spring 27*c* for biasing the valve body 27*a* into contact with the valve seat 27*b*, and the valve seat 27*b* is interposed between the upper and middle divided pieces 11*a*, 11*b*.

The valve body 27*a* and the spring 27*c* are inserted into the upper suction passage 19*a*. As shown in FIG. 2, the suction-side check valve 27 is configured to be opened by the separation of the valve body 27*a* from the valve seat 27*b* against a biasing force of the spring 27*c* if the pressure in the liquid storage part 18 (liquid storage space) of the pump body 11 becomes negative. In this way, the liquid is sucked into the liquid storage part 18 (liquid storage space) from the liquid tank 16 through the second suction passage 19.

As shown in FIG. 3, the suction-side check valve 27 is configured to close the second suction passage 19 by the contact of the valve body 27*a* with the valve seat 27*b* due to the biasing force of the spring 27*c* and prevent an outflow of the liquid in the liquid storage part 18 through the second suction passage 19 if the pressure in the liquid storage part 18 of the pump body 11 becomes positive.

Further, sealing members 10*a*, 10*b* are respectively provided in a joint part of the tank mounting piece 22 and the middle divided piece 11*b* and in a joint part of the upper discharge passage 12*a* of the upper divided piece 11*a* and the middle discharge passage 12*b* of the middle divided piece 11*b*. In this way, it is possible to prevent an outflow of the liquid to outside from those joint parts and prevent an inflow of outside air in those joint parts.

As shown in FIG. 1, the plunger pump 10 includes a driving device 30 serving as a driving mechanism for moving the plunger 15. The driving device 30 includes a housing 31 having an upper part of the pump body 11, i.e. the upper divided piece 11*a* of the pump body 11, mounted on a lower part, a movable body 32 mounded in the housing 31 movably in an axial direction of the plunger 15, an internally threaded part 34 provided on the movable body 32 and threadably engaged with a ball screw 33 extending in the axial direction of the plunger 15, the ball screw 33 threadably engaged with the internally threaded part 34 and provided in the housing 31 rotatably about an axis, and a servo motor 35 for rotating the ball screw 33.

A rail 31*b* is provided in parallel to the axial direction of the plunger 15 in the housing 31. The movable body 32 is vertically movably mounted on the rail 31*b*, and the servo motor 35 is provided in parallel to the housing 31. A first pulley 36 is provided on a rotary shaft 35*a* of this servo motor 35, a second pulley 37 is coaxially provided on the internally threaded part 34, and a belt 38 is wound on the first and second pulleys 36, 37.

On the other hand, an upper end of the plunger 15 projecting upward from an upper end of the pump body 11 is mounted on the movable body 32. Thus, the ball screw 33 rotates to couple the plunger 15 to the movable body 32 by driving the servo motor 35, whereby the plunger 15 can be moved in the axial direction together with the movable body 32 including the internally threaded part 34 threadably engaged with the ball screw 33.

It should be noted that the housing 31 is mounted on an arm 10*c* of an unillustrated robot for moving this plunger pump 10.

Further, the plunger pump 10 is provided with the liquid tank 16 for supplying the liquid to the pump body 11 through the suction passage 13. In the present embodiment, the liquid tank 16 includes a container body 41 having an open upper end and a tapered lower end and a lid body 39 for sealing an upper end opening of the container body 41. A holding bracket 31*a* for holding the container body 41 is mounted on the housing 31, and the tapered lower end of the container body 41 is mounted on a tip of the tank mounting piece 22.

Specifically, as shown in FIGS. 2 to 4, the flow hole 22*a* is formed to be open upward in the tip of the tank mounting piece 22, and an internal thread 22*b* is formed around an opening of the flow hole 22*a*. An externally threaded member 40 having an external thread 40*b* to be threadably engaged with the internal thread 22*b* formed around is attached to the tapered lower end of the container body 41.

The externally threaded member 40 is formed with a through hole 40*a* vertically penetrating along a center axis thereof. By threadably engaging the externally threaded member 40 with the internal thread 22*b*, the tapered lower end of the container body 41 can be so mounted on the tip of the tank mounting piece 22 that the container body 41 is vertical. In this state, the inside of the container body 41 and the flow hole 22*a* communicate in a watertight manner through the through hole 40*a* of the externally threaded member 40.

On the other hand, the liquid to be applied is poured and stored into the container body 41 from the upper end opening. As shown in FIG. 1, the lid body 39 for closing the upper end opening of the container body 41 is formed with a compressed air supply port 39*a* allowing the inside of the container body 41 to communicate with outside. Since the liquid is poured into the container body 41 from the upper end opening, the liquid moves to a lower part of the container body 41 by the own weight thereof to be stored and a space is formed in an upper part of the container body 41.

As just described, the upper end opening of the container body 41 having the liquid stored in the lower part is sealed by the lid body 39 and the compressed air is supplied into the container body 41 from the compressed air supply port 39*a* formed in the lid body 39 to increase a pressure in the space inside the container body 41 formed above the liquid, whereby the liquid flows under pressure into the flow hole 22*a* through the through hole 40*a* of the externally threaded member 40.

Next, the operation of the plunger pump 10 configured as described above is described.

The plunger pump 10 is mounted on the arm 10*c* (FIG. 1) of the unillustrated robot for moving the plunger pump 10. The liquid to be applied is poured from the upper end opening of the container body 41 of the liquid tank 16 and a necessary amount of the liquid is stored in the container body 41. Then, the upper end opening of the container body 41 is closed by the lid body 39.

Subsequently, all of the discharge passage 12, the suction passage 13 and the liquid storage space of the pump body 11 are filled with the liquid. At this time, if the liquid stored in the liquid tank 16 has a low viscosity, the liquid can be filled into the pump body 11 only by supplying the compressed air into the container body 41 from the compressed air supply port 39*a* formed in the lid body 39 and increasing the pressure in the space inside the container body 41.

Specifically, as shown in FIG. 4, the liquid flows into the flow hole 22*a* through the through hole 40*a* of the externally threaded member 40 provided in the lower part of the container body 41 by the pressure in the container body 41 and, thereafter, flows from the suction passage 13 formed in the pump body 11 to the discharge passage 12 by way of the liquid storage part 18, thereby entirely filling the inside of the pump body 11. At this time, as shown in FIG. 4, the second rod-like part 15*b* of the plunger 15 is preferably withdrawn from the first suction passage 13*d* to more quickly fill the liquid into the pump body 11. In this way, the liquid can quickly flow from the first suction passage 13*d* into the liquid storage part 18. It should be noted that since the suction-side check valve 27 is closed at this time, the liquid does not flow into the liquid storage part 18 from the second suction passage 19.

On the other hand, if the liquid stored in the liquid tank 16 has a high viscosity, the liquid is sucked by increasing the pressure in the space inside the container body 41 and increasing and decreasing a volume of the liquid storage space formed between the liquid storage part 18 and the plunger 15 through reciprocal movements of the plunger 15 with the first suction passage 13*d* closed by the second rod-like part 15*b* of the plunger 15.

Specifically, if the plunger 15 is moved from the side of the insertion port 14 to the side of the liquid storage part 18 (side of the first suction passage 13*d*) as shown in FIG. 3, the liquid (fluid) in the liquid storage space is discharged from the discharge passage 12 due to a volume reduction of the liquid storage space. On the other hand, if the plunger 15 is moved from the side of the liquid storage part 18 (side of the first suction passage 13*d*) to the side of the insertion port 14 as shown in FIG. 2, the liquid is sucked into the liquid storage space from the liquid tank 16 through the suction passage 13 due to a volume expansion of the liquid storage space. By repeating the reciprocal movements (reciprocal sliding movements) of the plunger 15 in this way, the liquid can be filled into the pump body 11.

After the inside of the pump body 11 is filled with the liquid, the first suction passage 13*d* is sealed and communication between the first suction passage 13*d* and the liquid storage space is cut off by reciprocally slidably inserting the tip of the second rod-like part 15*b* of the plunger 15 into the first suction passage 13*d* as shown in FIG. 3. This state is referred to as an initial state of application. From this state, the unillustrated robot moves the plunger pump 10 and causes the nozzle 24 to face an application position.

In actual application of the liquid at the application position, the plunger 15 is inserted from the side of the insertion port 14 to the side of the liquid storage part 18. As indicated by a downward facing solid-line arrow in FIG. 3, if the plunger 15 is moved from the initial state, the first rod-like part 15*a* enters the liquid storage part 18 from the insertion port 14 while the second rod-like part 15*b* comes out from the liquid storage part 18 into the first suction passage 13*d*. In this way, the volume of the liquid storage space formed between the liquid storage part 18 and the plunger 15 is reduced by a difference between a volume of the entering first rod-like part 15*a* and that of the coming-out second rod-like part 15*b*, and the pressure in the liquid storage part 18 becomes positive. Specifically, the inside of the liquid storage part 18 is set to a positive pressure while the plunger 15 is moved from the side of the insertion port 14 to the side of the liquid storage part 18.

If the pressure in the liquid storage part 18 becomes positive as shown in FIG. 3, the suction-side check valve 27 closes the second suction passage 19 by the contact of the valve body 27*a* with the valve seat 27*b* due to the biasing force of the spring 27*c*, wherefore an outflow of the liquid in the liquid storage part 18 through the second suction passage 19 is prevented.

On the other hand, if the pressure in the liquid storage part 18 becomes positive, the discharge-side check valve 26 opens the discharge passage 12 by the separation of the valve body 26*a* from the valve seat 26*b* against the biasing force of the spring 26*c* due to the positive pressure in the liquid storage part 18 and the liquid is discharged through the discharge passage 12 and the nozzle 24. Specifically, if the pressure in the liquid storage part 18 becomes positive, the liquid is discharged to outside from the liquid storage part 18 through the discharge passage 12 and the nozzle 24.

As just described, by using the plunger 15 including two rod-like parts 15*a*, 15*b* having different cross-sectional areas, a very small amount of the liquid can be discharged since the difference between the volume of the entering first rod-like part 15*a* and that of the coming-out second rod-like part 15*b* is a discharge amount.

For example, if the plunger 15 in which a cross-sectional area difference of the first and second rod-like parts 15*a*, 15*b* is 0.3 $mm^2$ is moved 10 mm, the volume of the liquid storage space is reduced by 3 $mm^2$. Thus, an amount of the liquid corresponding to a volume reduction can be discharged from the nozzle 24. Therefore, a very small amount of the liquid can be discharged with high accuracy without reducing the diameter and entrance amount of the plunger 15.

After a predetermined amount of the liquid is discharged, the discharge of the liquid from the nozzle 24 can be stopped by stopping the movement of the plunger 15. In this way, the inside of the liquid storage part 18 is set to the atmospheric pressure and the discharge-side check valve 26 closes the discharge passage 12 by the contact of the valve body 26*a* and the valve seat 26*b* due to the biasing force of the spring 26*c*, wherefore a flow of outside air into the liquid storage part 18 through the discharge passage 12 is prevented.

It should be noted that, in the case of changing the discharge amount, it is sufficient to change the entrance amount of the plunger 15 or change the cross-sectional area difference between the first and second rod-like parts 15*a*, 15*b*. However, the diameter of the first rod-like part 15*a* having a circular cross-section is desirably 1 mm or more to properly maintain a close contact state with the packing 28.

After the liquid is discharged, the plunger 15 is moved from the side of the liquid storage part 18 (side of first suction passage 13*d*) to the side of the insertion port 14 to expand the volume of the liquid storage space formed between the liquid storage part 18 and the plunger 15, whereby the liquid is sucked into the liquid storage part 18 from the liquid tank 16 through the second suction passage 19.

Specifically, as indicated by an upward facing solid-line arrow in FIG. 2, if the plunger 15 is retracted from the state entering the liquid storage part 18 (i.e. if the plunger 15 is moved from the side of the liquid storage part 18 to the side of the insertion port 14) in sucking the liquid, the first rod-like part 15*a* comes out from the liquid storage part 18 into the insertion port 14 while the second rod-like part 15*b* enters the liquid storage part 18 from the first suction passage 13*d*. In this way, the volume of the liquid storage space increases by a difference between a volume of the entering second rod-like part 15*b* and that of the coming-out first rod-like part 15*a* and the pressure in the liquid storage part 18 becomes negative. Specifically, the inside of the liquid storage part 18 is set to a negative pressure while the plunger 15 is moved from the side of the liquid storage part 18 to the side of the insertion port 14.

Further, since the first suction passage 13*d* is sealed by inserting the second rod-like part 15*b*, which is the tip of the plunger 15, in sucking the liquid, the supply of the liquid to the liquid storage part 18 through the first suction passage 13*d* is prohibited.

In this case, since the second suction passage 19 is provided in parallel to the first suction passage 13*d* in the plunger pump 10, the suction-side check valve 27 provided in the second suction passage 19 opens the second suction passage 19 by the separation of the valve body 27*a* from the valve seat 27*b* against the biasing force of the spring 27*c* due to the negative pressure in the liquid storage part 18 as shown in FIG. 2 if the pressure in the liquid storage part 18 becomes negative. In this way, the liquid is sucked into the liquid storage part 18 from the liquid tank 16 through the second suction passage 19 in which the suction-side check valve 27 is in an open state.

Specifically, in the plunger pump 10, the liquid flows into the liquid storage part 18 through the second suction passage 19 even if the first suction passage 13*d* is sealed by the insertion of the tip of the plunger 15 and it is difficult to supply the liquid to the liquid storage part 18 through the first suction passage 13*d*. Thus, a considerable pressure drop (drastic pressure change) in the liquid storage part 18 is avoided and situations such as the evaporation of the liquid remaining in the liquid storage part 18 are prevented.

On the other hand, as shown in FIG. 2, the discharge-side check valve 26 closes the discharge passage 12 by the contact of the valve body 26*a* with the valve seat 26*b* due to the biasing force of the spring 26*c* if the pressure in the liquid storage part 18 becomes negative. Thus, the liquid is not discharged to outside from the liquid storage part 18 through the discharge passage 12.

Here, since the compressed air supply port 39*a* for increasing an internal pressure of the liquid tank 16 is formed in the liquid tank 16, the liquid can be quickly supplied from the liquid tank 16 to the liquid storage part 18 through the suction passage 13 by increasing the internal pressure of the liquid tank 16.

For example, if a liquid which easily generates bubbles is stored in the liquid tank 16, a positive pressure is applied to the liquid tank 16 and an inflow of the liquid into the liquid storage part 18 through the second suction passage 19 is promoted in advance by increasing the internal pressure of the liquid tank 16 before the plunger 15 is retracted to the side of the insertion port 14 so that the pressure in the liquid storage part 18 becomes negative. Thereafter, the plunger 15 can be retracted to the side of the insertion port 14 and returned to a discharge start position with the tip of the plunger 15 kept inserted in the first suction passage 13*d*. By retracting the plunger 15 to the side of the insertion port 14 with a time difference in this way, a pressure change in the liquid storage part 18 is avoided, wherefore an evaporation phenomenon of the liquid that easily generate bubbles can be reliably suppressed and accuracy in micro application can be stabilized.

Further, the sealing member 29 held in close contact with the outer peripheral surface of the second rod-like part 15*b* of the plunger 15 is inferior in sealability to the relatively long combined packing 28 held in close contact with the outer peripheral surface of the first rod-like part 15*a*. Even if the airtightness of the first suction passage 13*d*, into which the second rod-like part 15*b* is inserted, is impaired, the first suction passage 13*d* as the suction passage 13 communicates with the liquid tank 16. Thus, what flows into the liquid storage part 18 from the first suction passage 13*d* is the liquid. Thus, outside air from the first suction passage 13*d* does not intrude.

On the other hand, if a liquid having a high viscosity and having hardly any influence on evaporation is stored in the liquid tank 16, the liquid can be fed into the suction passage 13 from the liquid tank 16 by supplying compressed air from the compressed air supply port 39*a* to the liquid tank 16 and increasing the internal pressure of the liquid tank 16. By simultaneously retracting the plunger 15 to the side of the insertion port 14 to remove the second rod-like part 15*b* from the first suction passage 13*d*, the liquid is caused to flow into the liquid storage part 18 from the first suction passage 13*d*. In this way, even the liquid having a high viscosity and poor in fluidity can be quickly sucked and the liquid can be quickly filled into the liquid storage part 18.

Thus, in the plunger pump 10 in which the suction passage 13 includes the second suction passage 19 separately from the first suction passage 13*d*, a very small amount of the liquid can be discharged with high accuracy by preventing the suction and production of gas regardless of whether or not the liquid is the one that easily generate bubbles. Thus, it is possible to provide the plunger pump 10 compatible with the application of a liquid having a low to high viscosity.

According to the above embodiment, the following effects are achieved.

In the plunger pump 10 according to the present embodiment, the plunger 15 is reciprocally slidably inserted into the insertion port 14. By making the plunger 15 relatively thick, the close contact state with the insertion port 14 can be easily maintained and an inflow of air from the insertion port 14 can be effectively prevented. The liquid in the liquid storage space can be discharged from the discharge passage 12 by moving the plunger 15 to reduce the volume of the liquid storage space formed between the liquid storage part 18 and the plunger 15 (i.e. to set the liquid storage part 18 to a positive pressure).

Here, since the tip of the plunger 15 reciprocally slidably inserted in the insertion port 14 is removably inserted into the first suction passage 13*d* constituting the suction passage 13, a difference between a volume of the plunger 15 inserted into the liquid storage part 18 from the insertion port 14 and that of the tip of the plunger 15 removed from the liquid storage part 18 into the first suction passage 13*d* (i.e. a volume change amount of the plunger 15 located in the liquid storage part 18 by the insertion of the plunger 15) is the discharge amount of the liquid. Thus, a very small amount of the liquid can be discharged while an inflow of air from the insertion port 14 is prevented.

On the other hand, after the liquid is discharged, the liquid is sucked into the liquid storage part 18 from the liquid tank 16 through the suction passage 13 by moving the plunger 15 in a direction to expand the volume of the liquid storage space. Since the second suction passage 19 is provided in parallel to the first suction passage 13*d*, the liquid flows into the liquid storage space through the second suction passage 19 even if the tip of the plunger 15 is inserted in the first suction passage 13*d* and it is difficult to supply the liquid to the liquid storage part 18 through the first suction passage 13*d*. Therefore, a considerable pressure drop (drastic pressure change) in the liquid storage part 18 is avoided and the evaporation of the liquid remaining in the liquid storage space can be prevented.

Even if the viscosity of the liquid in the liquid tank 16 is high, a quick flow of such a highly viscous liquid into the liquid storage part 18 through the second suction passage 19 cannot be expected and the airtightness of the first suction passage 13*d* having the tip of the plunger 15 inserted therein is impaired, the liquid can quickly flow into the liquid storage space through the first suction passage 13*d* and outside air does not intrude from the first suction passage 13*d* since the first suction passage 13*d* communicates with the liquid tank 16.

Further, since the compressed air supply port 39*a* for increasing the internal pressure of the liquid tank 16 is formed in the liquid tank 16, even if the liquid stored in the liquid tank 16 has a high viscosity, the liquid can be quickly supplied from the liquid tank 16 to the liquid storage part 18 through the suction passage 13 by increasing the internal pressure of the liquid tank 16. As a result, the evaporation of the liquid based on a considerable pressure drop (drastic pressure change) in the liquid storage part 18 can be effectively prevented.

Further, since the plunger 15 includes the first rod-like part 15*a* reciprocally slidably supported in the pump body 11 and having the first cross-sectional area and the second rod-like part 15*b* coaxially formed on the tip of the first rod-like part 15*a*, removably insertable into the first suction passage 13*c* and having the second cross-sectional area different from the first cross-sectional area, the difference between the volume of the first rod-like part 15*a* entering the liquid storage part 18 and that of the second rod-like part 15*b* coming out from the liquid storage part 18 into the first suction passage 13*d* is the discharge amount of the liquid. Thus, the entrance amount of the plunger 15 entering the liquid storage part 18 and the discharge amount of the liquid can be made proportional to each other. Therefore, the discharge amount can be easily managed and can be made considerably smaller with high accuracy.

It should be noted that although the aforementioned embodiment has been described using the plunger having a circular cross-section, the cross-sectional shape of the plunger 15 is not limited to a circular shape. Specifically, a rectangular column-shaped plunger having a polygonal cross-section may be, for example, used if a tip part and a rear end part of the plunger 15 and the openings (insertion port 14 and first suction passage 13*d*) corresponding thereto and formed in the pump body 11 are configured to have a constant cross-sectional area and enable reciprocal sliding and sliding parts of the tip part and the rear end part of the plunger 15 have different cross-sectional areas.

Further, the configuration of an intermediate part (i.e. part not required to be in close contact with the insertion port 14 and the first suction passage 13*d*) of the plunger 15 is not particularly limited. For example, a plunger 15 configured to have a tapered intermediate part whose outer diameter gradually changes and have a tip part and a rear end part having different cross-sectional areas may be used. However, in terms of processability, it is preferable to use the aforementioned plunger 15 including the first and second rod-like parts having different cross-sectional areas.

Further, although the check valves 26, 27 configured to be opened and closed by the springs as the pressure in the liquid storage part 18 increases and decreases are used in the above embodiment, check valves configured to be opened and closed in synchronization with entering and retracting movements of the plunger 15, for example, by a control device, may be used besides these.

Embodiments of this invention were described above, but the above embodiments are merely examples of applications of this invention, and the technical scope of this invention is not limited to the specific constitutions of the above embodiments.

This application claims priority based on Japanese Patent Application No. 2017-238252 filed with the Japan Patent Office on Dec. 13, 2017, the entire contents of which are incorporated into this specification.

The invention claimed is:

1. A plunger pump, comprising:

a liquid tank;

a pump body including a liquid storage part, a suction passage configured to allow communication between the liquid storage part and the liquid tank and a discharge passage configured to discharge a liquid from the liquid storage part to outside; and a plunger reciprocally movably supported in the pump body so that a tip reaches the liquid storage part, wherein:

the liquid is sucked into the liquid storage part from the liquid tank through the suction passage by a volume expansion of a liquid storage space formed between the liquid storage part and the plunger while the liquid is discharged through the discharge passage by a volume reduction of the liquid storage space as the plunger reciprocally moves, the suction passage includes a first suction passage, the tip of the plunger being reciprocally slidably inserted into the first suction passage, and a second suction passage provided in parallel to the first suction passage, and a check valve disposed in the second suction passage is configured to regulate fluid flow through the second suction passage from the liquid tank to the liquid storage space.

2. The plunger pump according to claim 1, wherein:

a compressed air supply port configured to increase an internal pressure is formed in the liquid tank.

3. The plunger pump according to claim 1, wherein the plunger includes:

a first rod part reciprocally slidably supported in the pump body, the first rod part having a first cross-sectional area; and a second rod part coaxially formed on a tip of the first rod part, the second rod part being insertable into and removable from the first suction passage, the second rod part having a second cross-sectional area different from the first cross-sectional area, the second rod part being the tip of the plunger.

4. The plunger pump according to claim 1, wherein:

the second suction passage communicates with a first end of the liquid storage part, and the first suction passage communicates with a second end of the liquid storage part.

* * * * *